United States Patent [19]

Nakajima et al.

[11] Patent Number: 4,986,741

[45] Date of Patent: Jan. 22, 1991

[54] VANE COMPRESSOR WITH BALL VALVE LOCATED AT THE END OF VANE BIASING CONDUIT

[75] Inventors: Nobuyuki Nakajima; Masaya Moruta; Toshio Yamaguchi; Kazuo Eitai, all of Konan, Japan

[73] Assignee: Diesel Kiki Co., Ltd., Tokyo, Japan

[21] Appl. No.: 428,592

[22] Filed: Oct. 30, 1989

[30] Foreign Application Priority Data

Nov. 4, 1988 [JP] Japan ..... 63-144191[U]

[51] Int. Cl.[5] ..... F04C 29/10

[52] U.S. Cl. ..... 418/268; 137/517

[58] Field of Search ..... 418/268, 269; 137/539, 137/517, 519.5

[56] References Cited

U.S. PATENT DOCUMENTS 4,543,049 9/1985 Shibuya ..... 418/269

FOREIGN PATENT DOCUMENTS 176492 8/1984 Japan .

140689 4/1920 United Kingdom ..... 137/517

*Primary Examiner*—John J. Vrablik

*Assistant Examiner*—David L. Cavanaugh

*Attorney, Agent, or Firm*—Charles S. McGuire

[57] ABSTRACT

A vane compressor has a communication passageway extending between a discharge pressure chamber and vane back pressure chambers. A valve is formed of a ball received within a ball-receiving bore and displaceable for opening and closing the communication passageway depending upon discharge pressure, a coiled spring urging the ball toward a valve opening position, and a stopper for stopping the ball in the valve opening position. The ball-receiving bore has an axial length smaller than an inner diameter thereof such that part of the ball is projected from the ball-receiving bore into the discharge pressure chamber when the ball is in the valve opening position.

6 Claims, 4 Drawing Sheets

VANE COMPRESSOR WITH BALL VALVE LOCATED AT THE END OF VANE BIASING CONDUIT

BACKGROUND OF THE INVENTION

This invention relates to a vane compressor in which vanes can be smoothly moved radially outwardly at the start of the compressor.

A variable capacity vane compressor for use in air conditioners for automotive vehicles or the like has been proposed e.g. by Japanese Provisional Patent Publication (Kokai) No. 59-176492 assigned to the assignee of the present application, which has a rotor formed with vane slits in which associated vanes are slidably fitted, vane back pressure chambers each defined within a vane slit by the associated vane, a communication passage communicating between a discharge pressure chamber with the vane back pressure chambers, a valve arranged in the communication passage for opening the communication passage to introduce discharge pressure into the vane back pressure chambers when the discharge pressure within the discharge pressure chamber is lower than a predetermined value, and closing the communication passage when the former is higher than the latter, to thereby permit the vanes to be moved radially outward into close sliding contact with the inner peripheral wall of the cylinder at the start of the compressor and hence improve the startability of the compressor.

According to the proposed compressor, as shown in FIG. 1, the valve 60 is formed of a cylindrical ball-receiving bore 62, a ball 63 as a valve body received within the bore 62, a coiled spring 64 urging the ball 63 in a direction of opening the valve, and a stopper pin 65 for stopping the ball 63 in a valve opening position, whereby the valve 60 assumes the valve opening position and a valve closing position depending upon the discharge pressure within the discharge pressure chamber.

However, the ball-receiving bore 62 has a large axial length as compared with the diameter of the ball 63 so that there is a possibility of accumulation of oil in a gap between an outer surface portion of the ball 63 closer to the discharge pressure chamber and the inner wall of the bore 62. Consequently, even when the ball 63 is in the valve opening position, the gap between the ball 63 and the bore 62 is choked up with the accumulated oil, which obstructs introduction of the discharge pressure from the discharge pressure chamber into the vane back pressure chambers through the bore 62. As a result, the pressure within the vane back pressure chambers cannot rise to such a sufficient level as to cause the vanes to be moved out of the slits into close contact with the inner peripheral surface of the cylinder, often resulting in chattering of the vanes and degraded startability of the compressor.

Further, in order to eliminate variations in the valve closing characteristic such as valve closing pressure of the ball valve between individual ball valves, that is, in order to allow the valve to positively become closed when the discharge pressure reaches the predetermined value, the inner diameter of the ball-receiving bore 62 should be machined with close tolerances so as to provide an appropriate gap between the ball 63 and the bore 62. However, accurate machining of the bore 62 is difficult because of the large axial length of the bore 62, hence making it difficult to machine the receiving bore 62 to an appropriate inner diameter.

SUMMARY OF THE INVENTION

It is an object of the invention to provide a vane compressor in which discharge pressure can be smoothly introduced into the vane back pressure chambers to allow the vanes to be smoothly radially outward at the start of the compressor, to thereby prevent chattering of the vanes as well as to improve the startability of the compressor.

It is a further object of the invention to provide a vane compressor having a ball valve for introducing discharge pressure into the vane back pressure chambers, which is designed to facilitate machining of the ball-receiving bore with close tolerances.

To achieve the above objects, the present invention provides a vane compressor having a cylinder, a rotor rotatably received within the cylinder and having vane slits formed therein, vanes each radially slidably fitted in an associated one of the vane slits, vane back pressure chambers each formed adjacent an associated one of the vane slits within the rotor, a discharge pressure chamber, communication passage means formed in the cylinder and extending between the discharge pressure chamber and the vane back pressure chambers, the communication passage means having a ball-receiving bore opening at one end thereof into the discharge pressure chamber, a valve arranged in the communication passage means for opening the communication passage means when discharge pressure within the discharge pressure chamber is lower than a predetermined valve, the valve having a valve body formed of a ball received within the ball-receiving bore and displaceable between a valve opening position and a valve closing position depending upon the discharge pressure, urging means urging the ball toward the valve opening position, stopper means for stopping the ball in the valve opening position.

The compressor according to the invention is characterized by an improvement wherein the ball-receiving bore has an axial length smaller than an inner diameter thereof such that part of the ball is projected from the ball-receiving bore into the discharge pressure chamber when the ball is in the valve opening position.

Preferably, the cylinder may be formed of a cam ring having opposite open ends, and a pair of side blocks closing means comprising at least one annular groove formed in one end face of one of the side blocks facing the rotor for communication with each of the vane back pressure chambers, and a communication through hole formed through the one side block and having the ball-receiving bore at one end thereof and opening at the other end thereof into the at least one annular groove.

More preferably, the stopper means comprises a stopper pin force fitted in the one side block and projected therefrom into the discharge pressure chamber.

The valve may have a valve seat provided in the ball-receiving bore and on which the ball is seated, the ratio (A/B) of the distance A between the valve seat and the open end of the ball-receiving bore to the distance B between the valve seat and one end face of the communication through hole opening into the at least one annular groove being from 0.03 to 0.05.

The above and other objects, features and advantages of the invention will become more apparent from the ensuing detailed description taken in conjunction with the accompanying drawings.

DETAILED DESCRIPTION

The invention will not be described in detail with reference to the drawings showing an embodiment thereof.

Figures 2, 4:
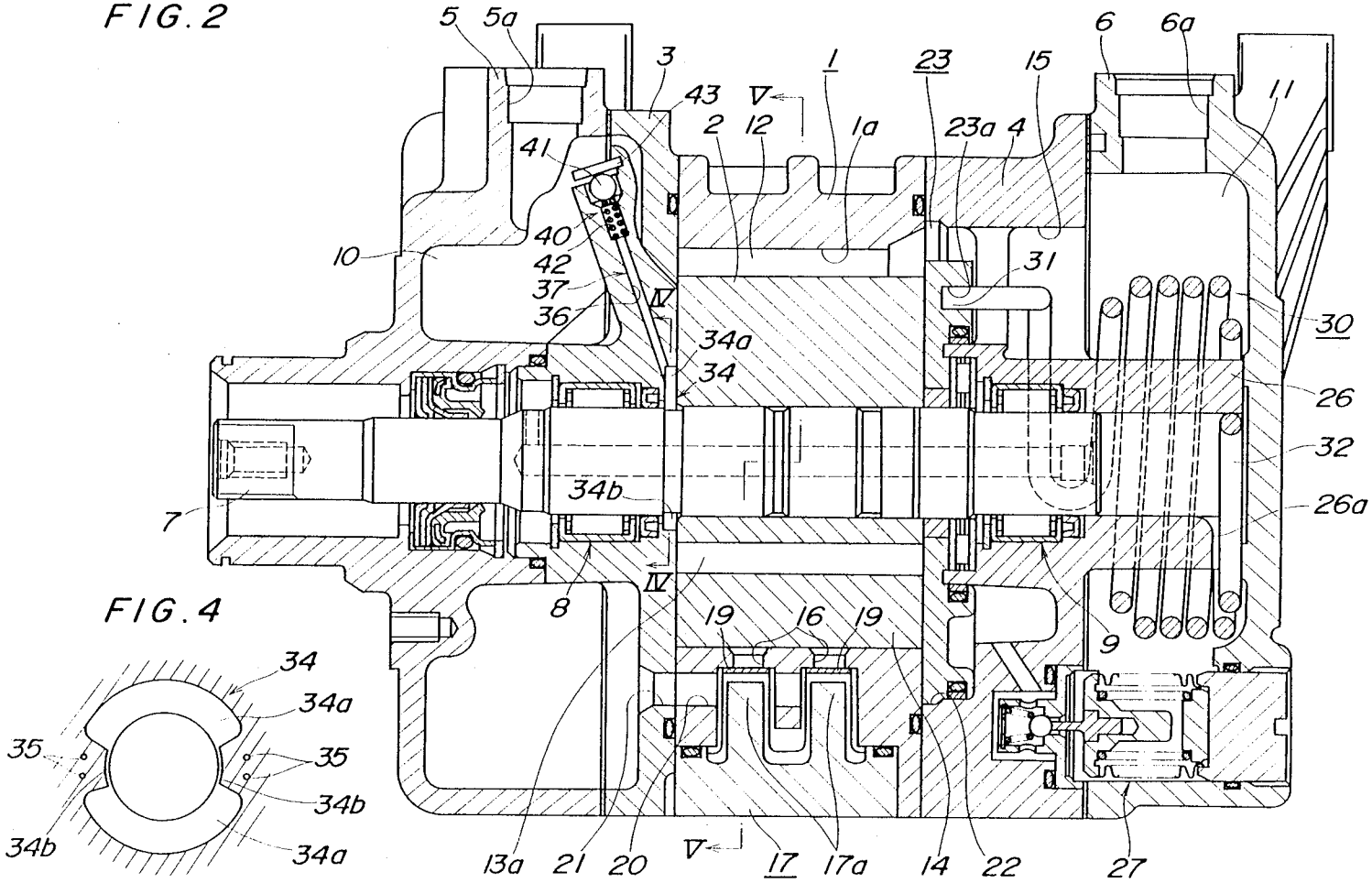
FIG. 2 is a longitudinal sectional view of a vane compressor according to the present invention.
FIG. 4 is a transverse sectional view taken along line IV—IV in FIG. 2.
Figure 5:
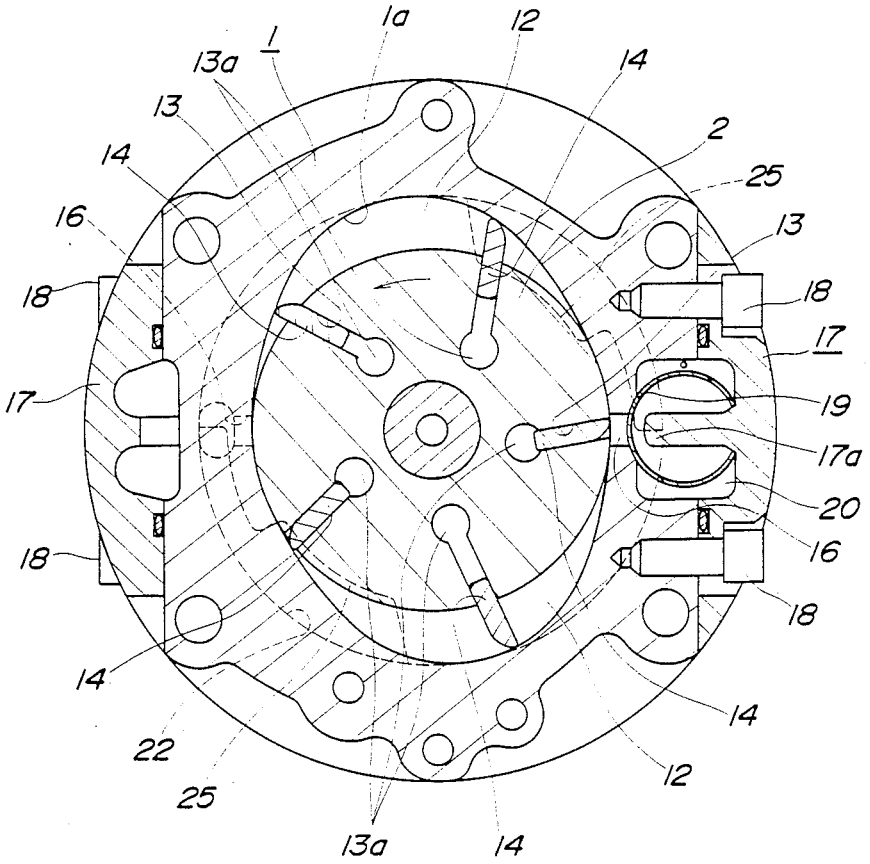
FIG. 5 is a transverse sectional view taken along line V—V in FIG. 2, wherein a control element is in a full capacity position.

Referring to FIGS. 2 through 6, there is illustrated a variable capacity vane compressor according to an embodiment of the invention. As shown in FIGS. 2 and 5, the compressor has a cylinder formed by a cam ring 1 having an inner peripheral camming surface 1*a* with a generally elliptical cross section, and a front side block 3 and a rear side block 4 closing open opposite ends of the cam ring 1, a cylindrical rotor 2 rotatably received within the cylinder, a front head 5 and a rear head 6 secured to outer ends of the respective front and rear side blocks 3 and 4, and a driving shaft 7 on which is secured the rotor 2. The driving shaft 7 is rotatably supported by a pair of radial bearings 8 and 9 provided in the respective side blocks 3 and 4.

A discharge port 5*a* is formed in an upper wall of the front head 5, through which a refrigerant gas is to be discharged as a thermal medium, while a suction port 6*a* is formed in an upper wall of the rear head 6, through which the refrigerant gas is to be drawn into the compressor. The discharge port 5*a* and the suction port 6*a* communicate, respectively, with a discharge pressure chamber 10 defined by the front head 5 and the front side block 3, and a suction chamber 11 defined by the rear head 6 and the rear side block 4.

As best shown in FIG. 5, a pair of compression spaces 12, 12 are defined at diametrically opposite locations between the inner pheripheral camming surface 1*a* of the cam ring 1, an outer peripheral surface of the rotor 2, an end face of the front side block 3 on the cam ring 1 side, and an end face of a control element 27 on the cam ring 1 side.

The rotor 2 has its outer peripheral surface formed therein with a plurality of (five in the illustrated embodiment) axial vane slits 13 at circumferentially equal intervals, in each of which a vane 14 is radially slidably fitted.

A pair of refrigerant inlet ports 15, 15 are formed in the rear side block 4 at diametrically opposite locations, only one of which is shown in FIG. 2. These refrigerant inlet ports 15, 15 axially extend through the rear side block 4 and through which the suction chamber 11 are communicated with the compression spaces 12 and 12.

A pair of refrigerant outlet ports 16, 16 are formed through opposite lateral side walls of the cam ring 1 at diametrically opposite locations, as shown in FIGS. 2 and 5, only one of which is shown in FIG. 2. The opposite lateral side walls of the cam ring 1 are provided with two discharge valve covers 17, 17, each formed integrally with a valve stopper 17*a*, and fixed to the cam ring 1 by fixing bolts 18. Discharge valves 19, 19 are mounted between the respective lateral side walls of the cam ring 1 and the valve covers 17, 17 in such a manner that they are supported by the valve covers 17, 17. A pair of communication passages 20, 20 are defined between the respective lateral side walls of the cam ring 1 and the valve covers 17, 17, which communicate with the respective refrigerant outlet ports 16 when the associated discharge valves 19 are open. A pair of communication passages 21, 21 are formed in the front side block 3, which communicate with the respective communication passages 20.

With such arrangement, when the discharge valves 19 open to thereby open the refrigerant outlet ports 16, a compressed refrigerant gas in the associated compression space 12 is discharged through the refrigerant discharge outlet ports 16, the communication passages 20, 21 and the discharge pressure chamber 10, in the mentioned order, to be discharged into a refrigerating circuit, not shown, through the discharge port 5*a*.

As shown in FIGS. 2 and 5, the rear side block 4 has an end face facing the rotor 2, in which is formed an annular recess 22. A control element 24, which is in the form of an annulus, is received in the annular recess 22 for rotation about its own axis in opposite circumferential directions. The control elements 24 has its outer peripheral edge formed with two diametrically opposite arcuate cut-outs 25, 25, and its one side surface formed integrally with a pair of diametrically opposite pressure-receiving protuberances, not shown, which are axially projected therefrom and act as pressure-receiving elements. Each of the pressure receiving protuberances has opposite side surfaces, one of which is acted upon by the suction pressure Ps as low pressure, whereas the other side surface is acted upon by control pressure Pc as high pressure created from the discharge pressure Pd supplied from the compression space 12 through a restriction passage, not shown. The control pressure Pc is varied by the control valve device 27 such that the suction pressure Ps is brought to a predetermined value.

The control element 23 is urged by a torsion coiled spring 30, which, as shown in FIG. 2, is fitted around a hub 26 of the rear side block 4 axially extending through the suction chamber 11 with its one end 31 engaged in an engaging hole 23*a* formed in one side surface of the control element 23 remote from the rotor 2 and its other end 32 engaged in a retaining groove 26*a* formed in an end face of the hub 26. Thus, the control element 23 is rotatable in opposite directions in response to the difference between the the sum of the suction pressure Ps and the urging force of the torsion coiled spring 30, and the control pressure Pc, between two extreme positions, i.e. a full capacity position shown in FIG. 5 wherein the compression starting timing is advanced to the earliest timing for obtaining the maximum delivery quantity or capacity of the compressor, and a partial capacity position shown in FIG. 6 wherein the compression starting timing is retarded to the latest timing for obtaining the minimum delivery quantity or capacity.

As shown in FIGS. 2 and 4, the front side block 3 has one end face facing the rotor 2 in which is formed an annular groove 34. The annular groove 34 has a pair of enlarged portions 34*a*, 34*a* at diametrically opposite locations, and also a pair of narrowed portions 34*b*, 34*b* interposed between the enlarged portions 34*a*, 34*a* at diametrically opposite locations. The enlarged portions 34*a*, 34*a* each circumferentially extend over an angular range between a location at which the suction stroke starts and a location at which the compression stroke is almost completed, so that the portion 34a communicates with each vane back pressure chamber 13a while the associated vane 14 travels within the above angular range. On the other hand, the narrowed portions 34b, 34b each circumferentially extend over an angular range between a location at which the compression stroke is almost completed and a location at which the discharge stroke is completed, so that the portion 34b is disconnected from each vane back pressure chamber 13a while the associated vane 14 travels within the annular range. The enlarged portion 34a, 34a are in communication with each other through the narrowed portions 34b, 34b.

A pair of oil feed holes 35, 35 are formed through the front side block 3 such that each hole 35 opens at one end thereof in one of the narrowed portions 34b, 34b and opens at the other end thereof into an oil sump, not shown, provided in a bottom of the discharge pressure chamber 10. When each vane 14 is in the narrowed portion 34b, i.e. between the location at which the compression stroke is almost completed and the location at which the discharge stroke is completed, oil within the oil sump is introduced into the associated vane back pressure chamber 13a through the oil feed hole 35.

Figure 1:
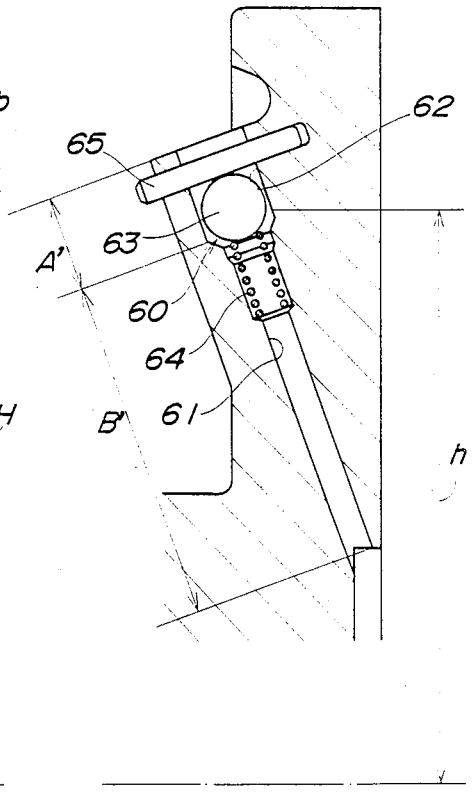
FIG. 1 PRIOR ART
FIG. 1 is a fragmentary sectional view of essential parts of a prior art compressor.

As shown in FIGS. 1 and 2, a communication through hole 36 is formed through the front side block 3, which opens at one end thereof into one of the enlarged portions 34a, 34a and open at the other end thereof into the discharge pressure chamber 10. The communication through hole 36 cooperates with the enlarged portions 34a, 34a and the narrowed portions 34b, 34b to constitute communication passage means 37 for communication of the discharge pressure chamber 10 with the vane back-pressure chambers 13a. A ball valve 40 is arranged in the communication through hole 36. Specifically, the ball valve 40 comprises a ball 41 as a valve body received in a cylindrical ball-receiving bore 36a which is in the form of an enlarged portion at one end of the communication through hole 36 opening into the discharge pressure chamber 10. The ball-receiving bore 36a has a valve seat 36b in the form of a stepped shoulder at a bottom thereof. A spring accommodating enlarged portion 36c is formed adjacent to the bore 36a via the valve seat 36b, in which is accommodated coiled spring 42 urging the ball 41 in a direction of opening the valve. A stopper pin 43 is force fitted in the front side block 3 and projected therefrom into the discharge pressure chamber 10 in front of the bore 36a for stopping the ball 41 in a valve opening position. With such arrangement, the ball valve 40 operates such that when the discharge pressure Pd within the discharge pressure chamber 10 is lower than a predetermined value, the ball 41 is biased by the force of the coiled spring 42 against the discharge pressure Pd to open the communication through hole 36 (valve opening position), and when the discharge pressure Pd is higher than the predetermined value, the ball 41 is seated on the valve seat 36b by the discharge pressure Pd against the force of the spring 42 to close the communication through hole 36 (valve closing position). The ball-receiving bore 36a has an axial length smaller than the inner diameter of the bore 36a, i.e. the diameter of the ball 41 so that part of the ball 41 is projected out of the open end of the bore 36a into the discharge pressure chamber 10. Preferably, the ratio between the axial length and the inner diameter should be from 0.5 to 0.6. (In the conventional vane compressor, the same ratio is about 1.5).

Figure 3:
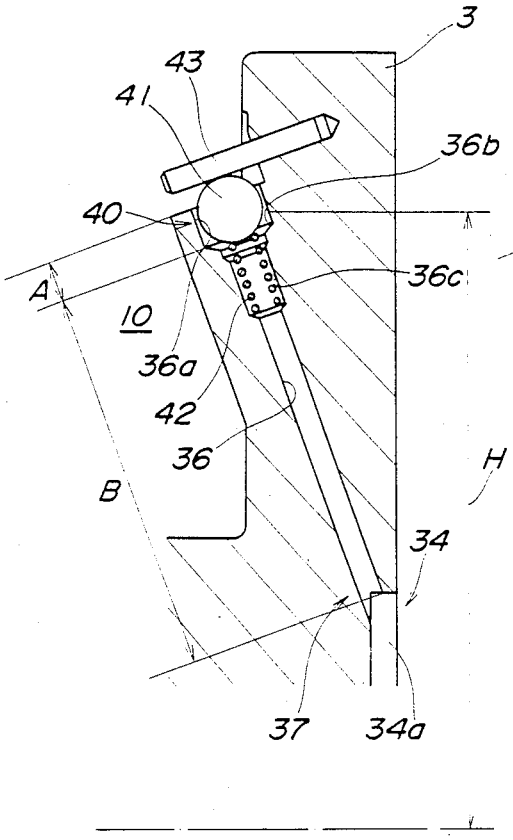
FIG. 3 is an enlarged fragmentary sectional view of essential parts of the compressor of FIG. 2.
Figure 6:
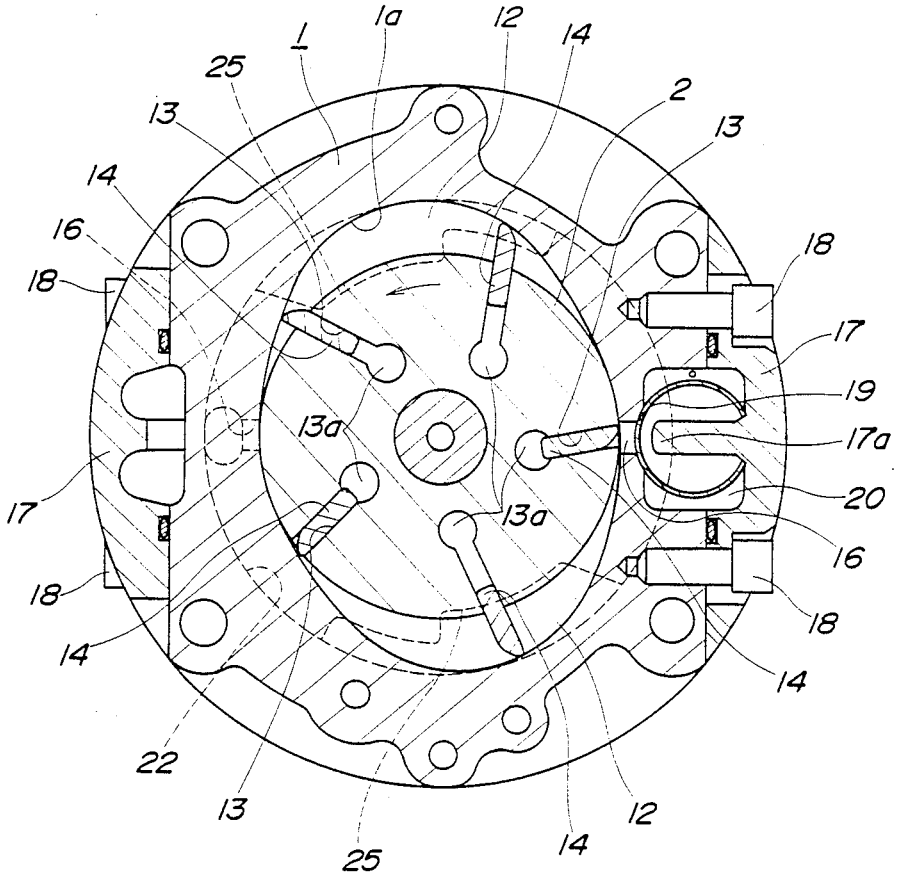
FIG. 6 is a view similar to FIG. 5, wherein the control element is in a partial capacity position.

Further, in the FIG. 3 arrangement according to the invention, the ratio (A/B) of the distance A between the valve seat 36b and the open end of the bore 36a to the distance B between the valve seat 36b and one end face of the communication through hole 36 opening into the one enlarged portion 34a is smaller than the corresponding ratio (A'/B') of the FIG. 6 arrangement according to the prior art. That is, the ratio (A/B) should be from 0.03 to 0.05, whereas the ratio (A'/B') is about 0.12. As a result, the distance H between the center of the ball 41 in the valve opening position and the center of the driving shaft 7 in the arrangement according to the invention is larger than the corresponding distance h in the arrangement according to the prior art. This feature according to the invention also contributes to positive prevention of accumulation of oil over an outer surface portion of the ball 41 closer to the discharge pressure chamber 10, since the ball-receiving bore 36a is at a substantially higher level in the discharge pressure chamber 10 than in the prior art arrangement.

The operation of the variable capacity vane compressor constructed as above will be explained below.

At the start of the compressor when the drive shaft 7 is rotated by an engine, not shown, or the like to rotate the rotor 2, the discharge pressure Pd within the discharge pressure chamber 10 is usually below the predetermined value. Accordingly, the ball 41 of the ball valve 40 is biased in the valve opening position as shown in FIG. 1 by the force of the coiled spring 42 so that the communication through passage 36 is opened by the ball 41 to thereby introduce the discharge pressure Pd from the discharge pressure chamber 10 therethrough into the one enlarged portion 34a of the annular groove 34, wherefrom part of the discharge pressure Pd is further introduced into the other enlarged portion 34a via the narrowed portions 34b, 34b. Thus, the both enlarged portions 34a and 34a are supplied with discharge pressure Pd. The enlarged portions 34a, 34a are communicated with each vane back pressure chamber 13a while the associated vane 14 is between the suction stroke-starting position and the compression stroke-almost completing position. Therefore, at the start of the compressor, before the discharge pressure Pd within the discharge pressure chamber 10 reaches the predetermined value, the discharge pressure Pd is introduced from the discharge pressure chamber 10 through the communication through hole 36 and the enlarged portions 34a, 34a (i.e. through the communication passage means 37) into each vane back pressure chamber 13a while the associated vane is between the suction stroke-starting position and the compression stroke-almost completing position. Consequently, the associated vane 14 is smoothly moved radially outward into close contact with the inner peripheral camming surface 1a of the cam ring 1, whereby the vanes 14 are prevented from chattering and also the compressor has improved startability. On the other hand, oil within the oil sump at the bottom of the discharge pressure chamber 10 under the discharge pressure Pd is introduced through the oil feed holes 35, 35 into the vane back pressure chambers 13a while the associated vanes 14 are between the compression stroke-almost completing position and the discharge stroke-completing position.

When the ball valve 40 is in the valve opening position, since the ball 41 is partly projected into the discharge pressure chamber 10 out of the open end of the ball-receiving bore 36a, oil is hardly accummulated over an outer surface portion of the ball 41 closer to the discharge pressure chamber 10 . Consequently, there is no fear of blockage of a gap between the ball 41 and the inner wall surface of the ball-receiving bore 36a , thereby facilitating the introduction of the discharge pressure into the vane back pressure chambers 13a therethrough.

When the compressor is brought into a steady operating state where the discharge pressure Pd within the discharge pressure chamber 10 is higher than the predetermined value, the ball 36a is forced by the discharge pressure Pd against the force of the spring 42 to be seated on the valve seat 36b to close the communication passage 36, thus assuming a valve closing position. Then, the discharge pressure Pd, which is higher than the predetermined value, is inhibited from being introduced through the communication passage means 37 into the vane back pressure chambers 13a, even when the associated vanes 14 are between the suction strike-starting position and the compression stroke-almost completing position. On this occasion, the enlarged portions 34a, 34a of the annular groove 34 are supplied with pressure from the compression spaces 12, 12 through a small clearance defined between the end face of the front side block 3 and an opposed end face of the rotor 2. Therefore, the pressure within the enlarged portions 34a, 34a has a medium value between the discharge pressure Pd as high pressure and the suction pressure Ps as low pressure. Therefore, when the compressor is in the steady operating state, the medium pressure is introduced into each vane back pressure chamber 13a while the associated vane 14 is between the suction stroke-starting position and the compression stroke-almost completing position, thereby holding the vanes 14 in contact with the inner peripheral camming surface of the cam ring 1 with appropriate contact pressure.

Since the ratio A/B in the invention is smaller than the ratio A'/B' in the prior art so that the distance H in the invention is substantially longer than the distance h in the prior art, and hence the level of the ball-receiving bore 36a is substantially higher than that in the prior art, as shown in FIGS. 1 and 3, accummulation of oil between the ball 41 and the ball-receiving bore 36a is further positively prevented.

Further, since the axial length of the ball-receiving bore 36a is shorter than that in the prior art, it is much easier to machine the bore 36a to an accurate inner diameter with close tolerances, thereby enabling to attain a desired valve closing characteristic of the ball valve with ease.

Incidentally, the present invention is not limited to a variable capacity vane compressor, but it may also be applied to fixed capacity vane compressors. Furthermore, the invention may also be applied to vane compressors having an outer shell or compressor casing, in addition to the shell-less type as illustrated in which the cylinder is exposed to the outside.

What is claimed is:

1. In a vane compressor having a cylinder, a rotor rotatably received within said cylinder having vane slits formed therein, vanes each radially slidably fitted in an associated one of said vane slits, vane back pressure chambers each formed adjacent an associated one of said vane slits within said rotor, a discharge pressure chamber, communication passage means formed in said cylinder and extending between said discharge pressure chamber and said vane back pressure chambers, said communication passage means having a ball-receiving bore having a predetermined axial length and diameter opening at one end thereof into said discharge pressure chamber, a valve arranged in said communication passage means for opening said communication passage means when discharge pressure within said discharge pressure chamber is lower than a predetermined value, said valve having a valve body formed of a ball received within said ball-receiving bore and displaceable between a valve opening position and a valve closing position depending upon said discharge pressure, urging means urging said ball toward said valve opening position, stopper means for stopping said ball in said valve opening position, the improvement wherein said predetermined axial length is smaller than said diameter, and part of said ball projects from said ball-receiving bore into said discharge pressure chamber when said ball is in said valve opening position.

2. The compressor as claimed in claim 1, wherein the ratio of the axial length of said ball-receiving bore to the inner diameter of same is from 0.5 to 0.6.

3. The compressor as claimed in claim 1, wherein said cylinder is formed of a cam ring having opposite open ends, and a pair of side blocks closing said opposite open ends, said communication passage means comprising at least one annular groove formed in one end face of one of said side blocks facing said rotor for communication with each of said vane back pressure chambers, and a communication through hole formed through said one side block and having said ball-receiving bore at one end thereof and opening at the other end thereof into said at least one annular groove.

4. The compressor as claimed in claim 1, wherein said stopper means comprises a stopper pin force fitted in said one side block and projected therefrom into said discharge pressure chamber.

5. The compressor as claimed in claim 3, wherein said valve has a valve seat provided in said ball-receiving bore and on which said ball is seated, the ratio (A/B) of the distance A between said valve seat and said one open end of said ball-receiving bore to the distance B between said valve seat and one end face of said communication through hole opening into said at least one annular groove being from 0.03 to 0.05.

6. The compressor as claimed in claim 1 wherein the diameter of said ball is greater than said predetermined axial length.

* * * * *